US009153239B1

(12) United States Patent
Postelnicu et al.

(10) Patent No.: US 9,153,239 B1
(45) Date of Patent: Oct. 6, 2015

(54) DIFFERENTIATING BETWEEN NEAR IDENTICAL VERSIONS OF A SONG

(71) Applicant: Google Inc., Mountain View, CA (US)

(72) Inventors: Gheorghe Postelnicu, Zurich (CH); Matthew Sharifi, Zurich (CH)

(73) Assignee: Google Inc., Mountain View, CA (US)

( * ) Notice: Subject to any disclaimer, the term of this patent is extended or adjusted under 35 U.S.C. 154(b) by 310 days.

(21) Appl. No.: 13/803,686

(22) Filed: Mar. 14, 2013

(51) Int. Cl.
*G10L 19/018* (2013.01)

(52) U.S. Cl.
CPC ..... *G10L 19/018* (2013.01)

(58) Field of Classification Search
CPC ..... G10L 19/018; G06F 17/3074; G06F 17/30026
USPC ..... 704/270, 273, 278
See application file for complete search history.

(56) References Cited

U.S. PATENT DOCUMENTS

2006/0041753 A1* 2/2006 Haitsma ..... 713/176
2006/0122839 A1* 6/2006 Li-Chun Wang et al. ..... 704/273
2006/0149552 A1* 7/2006 Bogdanov ..... 704/273
2006/0229878 A1* 10/2006 Scheirer ..... 704/273
2007/0055500 A1* 3/2007 Bilobrov ..... 704/217
2008/0201140 A1* 8/2008 Wells et al. ..... 704/231
2009/0157391 A1* 6/2009 Bilobrov ..... 704/200.1
2010/0257069 A1* 10/2010 Levy et al. ..... 705/26
2011/0153050 A1* 6/2011 Bauer et al. ..... 700/94
2011/0276157 A1* 11/2011 Wang et al. ..... 700/94

OTHER PUBLICATIONS

Baluja, S., et al., "Content Fingerprinting Using Wavelets," 10 pages.
U.S. Appl. No. 13/450,427, filed Apr. 18, 2012, entitled, "Full Digest of an Audio File for Identifying Duplicates."

* cited by examiner

*Primary Examiner* — Michael N Opsasnick
(74) *Attorney, Agent, or Firm* — Amin, Turocy & Watson, LLP

(57) ABSTRACT

Identifying near identical versions of a probe sample from reference files comprises identifying discriminative regions of reference matches by generating a similarity matrix. The discriminative time frames are communicated to a client device and additional data associated with the probe sample can be retrieved having features of the discriminative regions. Based on the additional data, a single match can be generated to identify the probe sample.

20 Claims, 9 Drawing Sheets

DIFFERENTIATING BETWEEN NEAR IDENTICAL VERSIONS OF A SONG

TECHNICAL FIELD

This disclosure relates generally to receiving and processing media content streams for matching reference content, and in particular differentiating between versions of audio that are nearly identical.

BACKGROUND

Audio fingerprinting provides the ability to link short, unlabeled, snippets of audio content to corresponding data. It provides the ability to automatically identify and cross-link background audio, such as songs, and the tagging of songs with metadata (e.g., the performing artist's name, album name, etc.) can be accomplished. Unlike many competing technologies, a goal of audio fingerprinting is to perform the recognition without imposing extraneous hardware restraints to automatic detection and/or replacement, as well as without extraneous data transmission.

Various challenges are posed when systems do not function with exact bit-level matches when comparing content. The system may be functioning with only short snippets of audio content when a full song is not easily available. Because song fragments may be utilized, no fine or even coarse alignment of the audio content occurs, and the match comparison may occur anywhere within a song. Further, songs are commonly "sampled" into other songs, thereby making the identification of potential matches more ambiguous. When identifying songs played on a radio, for example, a radio station may change the speed of a song to fit their programming requirements. Additionally, there are difficulties introduced through the numerous forms of playback available to the end consumer. Music that is played through a cell phone, computer speakers, or high-end audio equipment will have very different audio characteristics.

SUMMARY

The following presents a simplified summary of various aspects of this disclosure in order to provide a basic understanding of such aspects. This summary is not an extensive overview of all contemplated aspects, and is intended to neither identify key or critical elements nor delineate the scope of such aspects. Its purpose is to present some concepts of this disclosure in a simplified form as a prelude to the more detailed description that is presented later.

Systems and methods disclosed herein relate to determining near identical versions of a matching reference that is identified using a compact digest of a probe sample (e.g., an audio track, or a song from a compact/compressed album or group of songs) received at a server. The server performs matching operations at a reference database to determine the various matching references of the probe sample against references (e.g., other songs). The matching references are further compared against each other in more detail and any discrepancy regions (areas of mismatching detail) from among audio features or finer details are further identified. The regions are communicated in order for the client device to re-compute the digests for further information associated with the time ranges of the discrepancy regions. Upon receiving the further information over the discriminative regions, a match with the greatest strength in relation to the set of matching references is identified as the match to the probe sample.

In one example of an embodiment, a system comprises a memory that stores computer executable components. A processor executes the computer executable components stored in the memory. A receiving component receives a first probe fingerprint associated with a probe media file from a client device. A comparing component generates a comparison of the first probe fingerprint to reference fingerprints associated with reference media files to identify matching reference fingerprints. A discrepancy component identifies discrepancy regions with the matching reference fingerprints, and a request component communicates a request to receive a data portion of the probe media file that corresponds to at least one discrepancy region of the discrepancy regions.

Another example of an embodiment includes a method that uses a processor to execute computer executable instructions stored in a memory to perform the acts. The method includes receiving a first probe fingerprint associated with a probe media file from a client device. The first probe fingerprint is compared to reference fingerprints associated with reference media files to identify matching reference fingerprints. In response to identifying the matching reference fingerprints, a set of discrepancy regions of the first probe fingerprint and the matching reference fingerprints are identified. A request is communicated to the client device that requests a subset of the probe media file with the set of discrepancy regions identified.

Also disclosed herein is a method using a processor to execute computer executable instructions of a memory that includes receiving a first probe fingerprint associated with a probe media file that is communicated from a client device. The first probe fingerprint is compared to reference fingerprints associated with reference media files to identify a set of matching reference media files having matching reference fingerprints. The set of matching reference media files are compared to determine a set of discrepancy regions. A match is determined from among the set of matching reference media files based on additional data of the probe media file associated with the discrepancy regions.

The following description and the annexed drawings set forth in detail certain illustrative aspects of this disclosure. These aspects are indicative, however, of but a few of the various ways in which the principles of this disclosure may be employed. This disclosure is intended to include all such aspects and their equivalents. Other advantages and distinctive features of this disclosure will become apparent from the following detailed description of this disclosure when considered in conjunction with the drawings.

DETAILED DESCRIPTION

Overview

Figure 1:
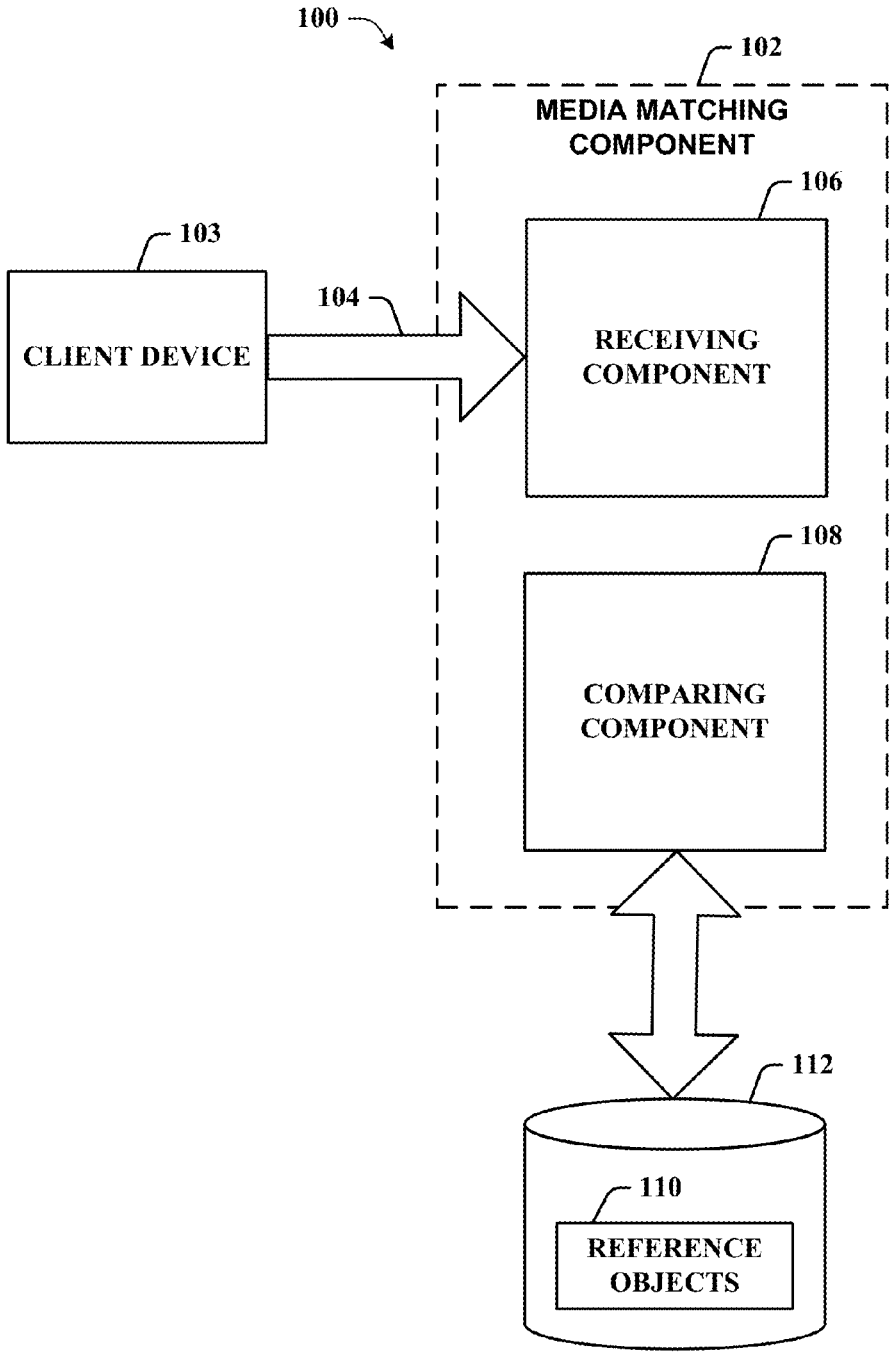
FIG. 1 is a block diagram illustrating an example, non-limiting embodiment of a matching system in accordance with various aspects and implementations described herein.

Various aspects of this disclosure are now described with reference to the drawings, wherein like reference numerals are used to refer to like elements throughout. In the following description, for purposes of explanation, numerous specific details are set forth in order to provide a thorough understanding of one or more aspects. It should be understood, however, that certain aspects of this disclosure may be practiced without these specific details, or with other methods, components, materials, etc. In other instances, well-known structures and devices are shown in block diagram form to facilitate describing one or more aspects.

In accordance with one or more implementations described in this disclosure, a content matching system can include matching schemes based on receiving digests of highly compact fingerprints for audio samples (e.g., songs, music recordings, album tracks or, songs of an album) and identifying the digests among a set of media references. For example, a compact digest can be generated based on sets of groupings of interest points that meet threshold criteria. The compact digest can be used in identifying a potential audio match. An audio match can be determined, for example, by analyzing an audio sample for unique characteristics that can be used in comparison to unique characteristics among one or more reference audio samples among a data store. A spectrogram or a window of a spectrogram, for example, can be also used in the comparison of the video/audio probe to identify an audio sample, in which the spectrogram represents an audio sample by plotting time on one axis and frequency or other parameter on another axis.

Because storing an entire spectrogram for multiple reference samples may not be efficient, compact descriptors of reference samples can be utilized to identify near duplicates or nearly identical versions of the same song or album track, such as with radio edits compared to an album version, and/or explicit versions versus non-explicit versions where the content can vary slightly, for example. Even though a variety of references could be near matches, only one of them can be a correct match. In an audio matching system, for example, the system can match the audio of a probe sample, e.g., a user uploaded audio clip, against a set of references, allowing for a match in any range of the probe sample and a reference sample. Thus, descriptors of the probe sample are generated based on snapshots (or subsets of correlated sample data—e.g., a spectrogram window) of the probe sample at different times, which are looked up in an index of corresponding snapshots (or fingerprints) from reference samples. When a probe sample has multiple matching snapshot pairs, they can be combined during matching to time align the probe sample and reference sample.

In some audio matching systems, the system can be tuned to match the entirety of an audio clip, e.g., finding full duplicates. For example, an audio matching system can be used to discover the identity of full audio tracks, songs, or portions of an album comprising a song or an audio subset in a user's collection of songs against a reference database of known songs. Such a system could be useful for any cloud music service to allow a user to match their collection against a set of known recordings. In another example, an audio matching system can be used to discover duplicates within a large data store or collection of audio subsets or tracks, for example. In yet another example, an audio matching system can be used for clustering together multiple user recordings. Using descriptors capable of matching any range of a probe sample to any range of a reference sample, could work for the previous examples; however, using more compact descriptors for the purpose of matching an entire audio subset (e.g., song track, or the like of an album or digest of audio subsets) can be more efficient and allow the system to scale to billions of reference samples.

As disclosed herein, methods and systems enable execution of a matching system to receive a portion of a sample or a probe sample for determining reference matches. When multiple matches are identified, they can be compared in pairwise comparison(s) and a similarity matrix be identified. The similarity matrix is utilized to formulate discrepancy regions with respect to time. The data gathered along a main diagonal of the similarity matrix is communicated to the client device for a re-computation of the digest at the particular discrepancy regions. The data is retrieved and used to more accurately identify the match among the set of matching reference samples.

Differentiating Between Near Identical Versions of a Song

Turning now to FIG. 1, illustrated is an example system 100 for audio identification using probe samples of media content in accordance with various aspects described in this disclosure. Generally, system 100 can include a memory that stores computer executable components and a processor that executes computer executable components stored in the memory, examples of which can be found with reference to FIG. 10. System 100 includes a media matching component 102. The media matching component 102 recognizes, identifies, or otherwise determines an identity of a comparison object 104 (e.g., a sample audio file) from a client device 103 by matching a portion of the comparison object 104, such as with known audio content (reference audio files), or a portion of known audio content that is similar to the comparison object 104 (e.g., as with a sample audio probe or file). The comparison object 104, for example, can include audio data, such as, songs, speeches, and/or sound portions of albums, such as song tracks, for example. For example, in one implementation, the comparison object 104 can include a video performance of a song uploaded to a media hosting service by a user, and the media matching component 102 can identify the song by determining a set of reference songs (or known songs) that are similar. Songs include, but are not limited to, performances of a reference song that feature different performers, instrumentation, performance conditions, and/or arrangements from the reference song. For example, a song can include a live performance of a recorded reference song featuring the original performer of the recorded reference song. As an additional or alternative example, a cover song can include a performance of a reference song by a performer other than the original performer. As such, near identical versions can be identified from the reference content, such as with radio edits of a song versus an album version, as well as explicit audio content versus non-explicit content having slightly varied content or changed versions.

The media matching component 102 includes a receiving component 106, and a comparing component 108. The receiving component 106 can operate to receive a portion or subset of data corresponding to a probe sample (a comparison object) such as a probe fingerprint that is associated with a media file (e.g., an audio subset, track, song of an album, and/or the like). The receiving component 102 is configured to receive, for example, a highly compact digest as a fingerprint of the probe sample. The digest could be computed over the entire sample (e.g., audio track) or only a portion of an audio subset, song, track, etc. by the client device 103.

In one embodiment, the media matching component 102 operates at a server or as a server, and in response to receiving the fingerprint (probe sample 104) further operates the comparison component 108 to generate a lookup of a reference database 112 that includes reference objects 110 for comparison. The reference objects can include media objects that are similarly encoded, such as with feature vector hashes, compacted digests or fingerprints, full fingerprints, spectrograms, and/or the like to provide corresponding comparison with the probe data received from the client device 103 for a comparable identification to result.

The comparison component 108 can determine whether zero or more reference audio files exist that are similar to the sample audio file, and recognize, categorize, or otherwise identify the reference audio files that are similar to the audio file 104 using the fingerprint received or generated. For example, in one implementation, the comparison component 108 compares the fingerprint, or a portion of the fingerprint of the comparison object 104 against a set of fingerprints, identifiers or reference objects 110 for reference audio files, and determines a set of reference audio files that are similar to the comparison object 104 (or portion of the comparison object) based at least in part on a set of similarity criteria. The similarity criteria can include but are not limited to satisfying a predetermined similarity threshold. As an additional or alternative example, in one implementation, the comparison component 108 can employ the fingerprint to lookup reference audio files that are similar to the audio file 104. For instance, the fingerprint can include a set of hash values, and the identification component 108 can employ the set of hash values to lookup a fingerprint in the set of fingerprints 110 for a reference audio file, e.g., using a hash table. It is to be appreciated that although the set of fingerprints or reference objects 110 are illustrated as being maintained in the data store 112, such implementation is not so limited. For instance, the reference objects 110 can be maintained in another location, and the comparison component 108 can access the objects 110, for example, via a network connection.

Figure 2:
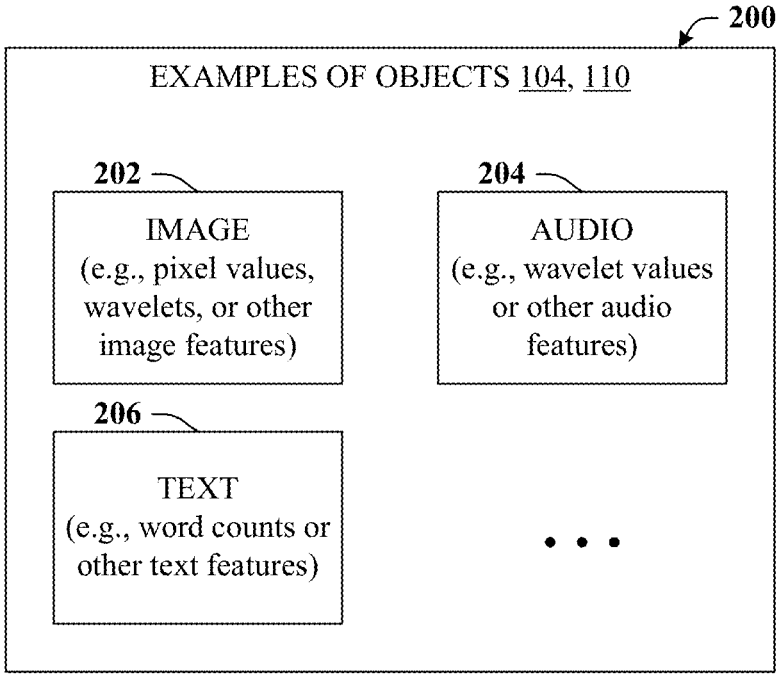
FIG. 2 depicts an example block diagram that illustrates various examples of a reference object and/or comparison object in accordance with certain embodiments of this disclosure.

Referring now to FIG. 2, illustrated is a diagram 200, which illustrates various examples of a reference object or a comparison object that the reference objects 110 and the comparison object 104 can respectively comprise. For example, the objects 104, 110 can relate to at least one of image 202, audio 204, and/or text 206. In the case where objects 104, 110 relate to an image 202, feature vectors can include an image feature such as pixel values for example, of a reference image and/or of a comparison image. In other embodiments, feature vectors can include wavelets or other features (including, for example, local features) associated with a reference image and a comparison image. In the case where objects 106, 110 relate to audio 204, then feature vectors can include wavelet values (or other features associated with audio) for the wavelets of a reference audio and of a comparison audio, for example, as well as compact digests of full length audio subsets, such as a set of tracks or songs of an audio digest, a portion of an audio subset, full length fingerprints, encoded hashes, a spectrogram, a window and/or portion of a spectrogram, and/or a portion of data that corresponds to the audio probe and/or the reference audio file. In the case where objects 106, 110 relate to text 206, then first feature vector 104 can include a word count for various words (or other features associated with text) included in a reference text and in a comparison text, for example. Examples 202, 204, and 206 are non-limiting and other examples can exist such as substantially any object that can be represented by a d-dimensional feature vector.

Figure 3:
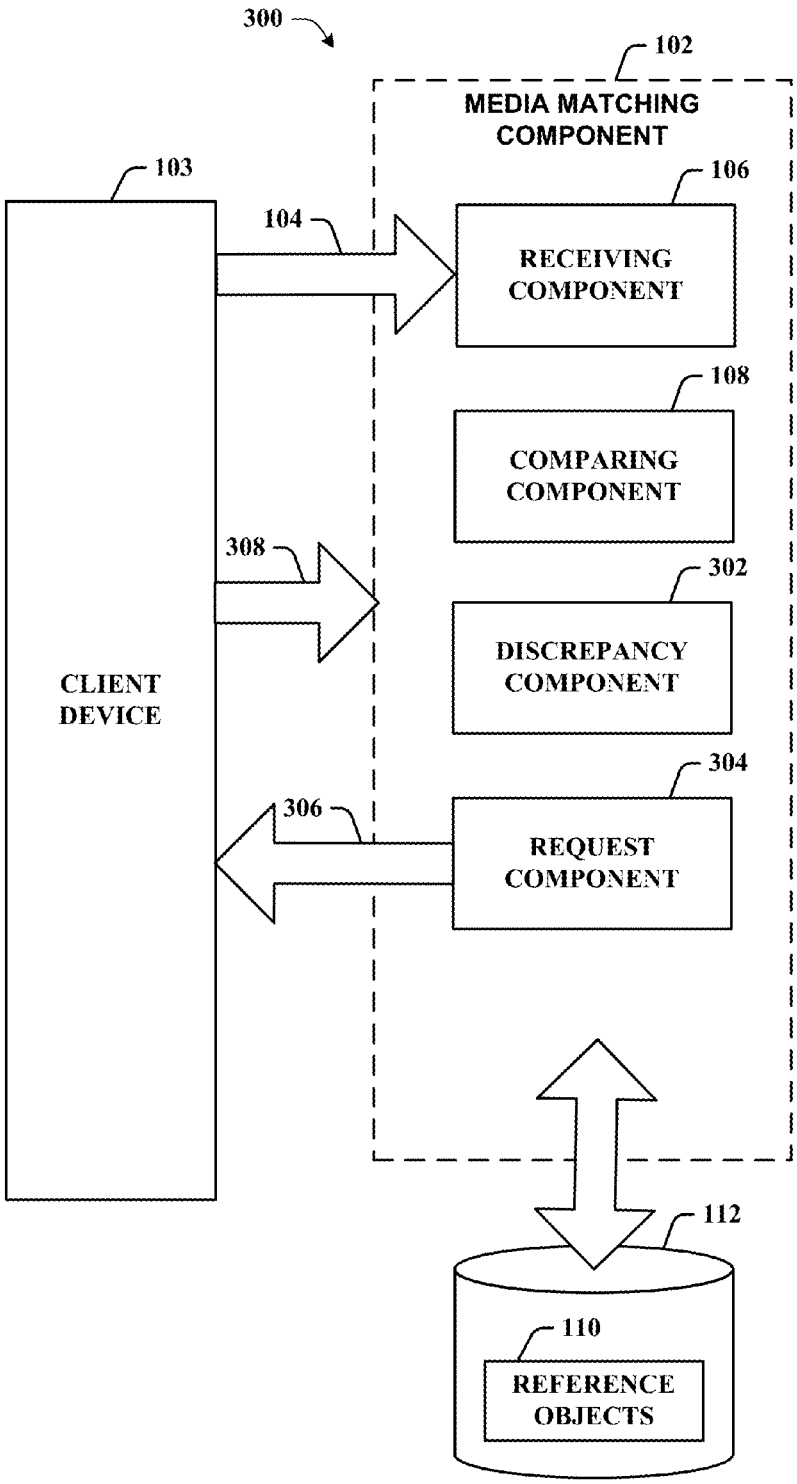
FIG. 3 is a block diagram illustrating an example, non-limiting embodiment of a system with a matching media component in accordance with various aspects and implementations described herein.

Turning now to FIG. 3, illustrated is an example system 300 for media content matching in accordance with various aspects described in this disclosure. For example, the system 300 can operate to identify nearly identical versions of a media file (e.g., a song or album track) from among matching references identified. The system 300 is similar to the system 100 discussed above and further comprises a discrepancy component 302 and a request component 304.

The discrepancy component 302 operates to identify discrepancy regions with the matching references identified by the media matching component 102. For example, in the case of audio, songs could be identified as reference objects 110 that could have different versions, vary in one or more parameters (e.g., quality, time, wave characteristics, etc.). The discrepancy component 302 is configured to analyze the discrepancies among these matching references (e.g., matching reference fingerprints).

For example, the discrepancy component 302 can generate a similarity matrix comparisons from comparisons of the set of matching references identified. In conjunction with the comparing component 108 and/or separately, offline for all pairs discovered or at each time a potential candidate reference is identified, comparisons are generated as pairwise comparisons across the set of matching references identified. The references identified by these operations represent potential candidates for a single strongest match with respect to all the match results.

In one embodiment, the comparisons are generated from among matching references, which can be identified based on overlapping spectrogram frames and measuring of a distance between normalized frames. For example, the distance can relate to a standard distance metric, L1, L2, a Jaccard distance metric and/or other distance measure between feature vectors of the pairwise comparison. In addition or alternatively, more detailed fingerprint comparisons can be generated among the matching reference samples by utilizing a Hamming distance.

For example, the discrepancy component 302 and/or comparing component 108 operate to generate one or more sequences of feature vectors by using a distance measure in pairwise comparisons. For example, comparisons of pairs of references can be performed along a range of times i and j corresponding to the pair of references respectively (e.g., ref_1 and ref_2) and be used to generate a similarity matrix, such as the similarity matrix 400 illustrated as one example in FIG. 4.

Figure 4:
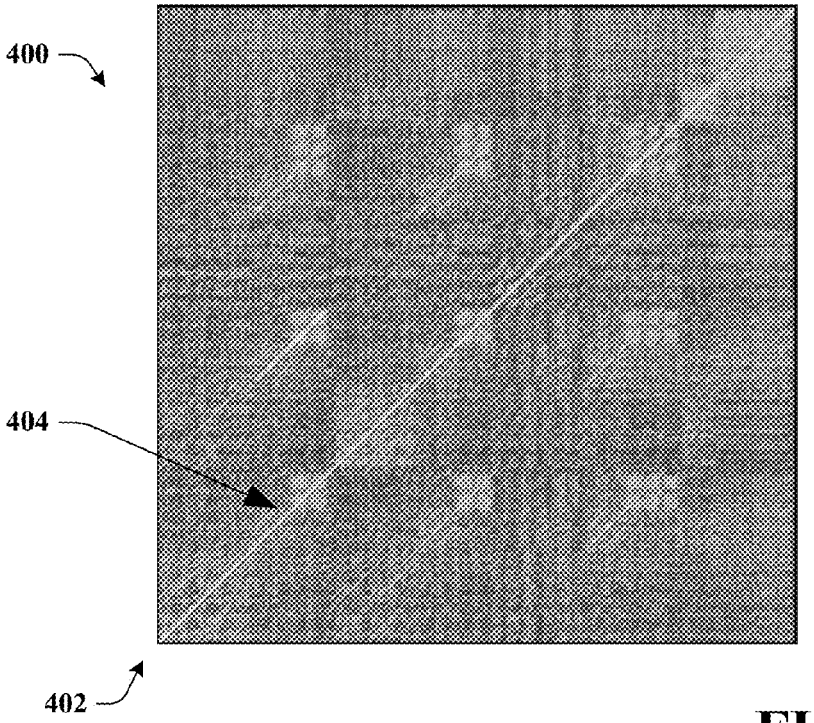
FIG. 4 is an example, non-limiting embodiment of a similarity matrix in accordance with various aspects and implementations described herein.

While still referring to FIG. 3, but turning now as well to FIG. 4, a similarity matrix 400 is depicted. A time origin 402 marks the time beginning at 0, 0 of pairwise references. The image has encoded some similarity or hashes of the features of the corresponding time space for time based signals of the pairwise references. Based on the nature of the matrix, the brighter areas or lighter areas illustrate greater similarity regions. The discrepancy component 302 further analyzes the data for a consistently high similarity, which is changing along a main diagonal line 404 of high signal. The similarity matrix is utilized to first find the alignment between the two references by accumulating similarities for the same i-j time regions. A maximum i-j (projection) is calculated to find the starting indices in the pairwise references (e.g., i_start ref__1 and j_start in ref__2). The matches are then observed along the diagonal 404 (e.g., 0, 0 to i, j, or from a bottom-left to top-right flow) and time indices that do not match at any instances in time are stored. If no matches are present the diagonal would be continuous and not disrupted.

Referring now to FIG. 3 again, the request component 304 is configured to communicate a request 306 to receive a data portion of the probe media file that corresponds to at least one discrepancy region of the discrepancy regions. Discrepancy regions are computed from a similarity matrix and then the request component transmits the computed time ranges back from the server or the media matching component 102 to the client device 103 requesting for further information related to the probe sample or comparison object 104. In response to the request 306 being received, the client device 103 can re-compute a digest over the highly discriminative ranges, such as by a hash, the features thereat, the entire length, and/or a digest computed over the sub-regions, which correspond to the discriminative regions identified. As such, the matching component 102 can be in communication with the data store 112 that can have compact fingerprints, full fingerprints and/or more details (a more detailed fingerprint) in order to compare when the further additional data as provided by the client device 103 in response to the request is received, such as spectrograms or a window/portion of a spectrogram, which comprises a greater resolution of the discrepancy or discriminative regions.

Once the discriminative digest 308 (a sub-section of the song, track, subset of an audio digest) that comprises the more detailed and/or additional information on the discriminative regions is retrieved by the matching component 102, identification is of the reference with the highest strength, which is closest in matching content to the discriminative regions and is determined to be the single correct match. The discriminative digest 308, for example can include additional or more detail related to discriminative ranges (e.g., 0,0 to i,j, and/or $i_1, j_1$ to $i_2, j_2$), such as by a hash, the features thereat, the entire length of the matrix 400 rather than subset of the matrix, and/or a digest computed over the sub-regions of the song (e.g., an track or an audio subset), which correspond to the discriminative regions identified in more detail or with greater information as requested by the request 306.

Figure 5:
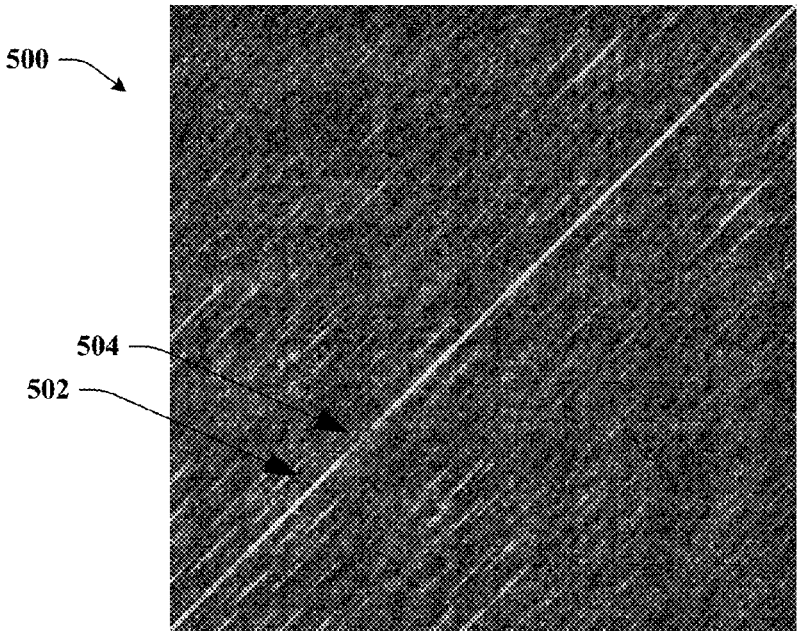
FIG. 5 is an example, non-limiting embodiment of a similarity matrix in accordance with various aspects and implementations described herein.

Referring to FIG. 5, illustrated is another example of a similarity matrix for ascertaining discriminative regions among pairwise matching references in accordance with various embodiments disclosed. For example, computing a sequence of overlapping spectrogram frames and measuring a distance (e.g., L2 distance) between normalized frames can generate a sequence of feature vectors. These detailed fingerprints or sequence of feature vectors can be compared utilizing a Hamming distance, or some other distance measure.

A similarity matrix, such as the similarity matrix 500 of FIG. 5 can be created by performing a comparison of all possible pairs of the matching references in time sequences of i and j. A main diagonal 502 flows from the time origin (0, 0) to (i,j), which flows from bottom right to top left with respect to time. Encoded are similarities between the features or hashes of the features that correspond to time space or time based signals. A feature vector is computed for each time i and j, in which the vectors are compared and computed independently, either together or at separate times. The alignments between the two references are identified by accumulating similarities for the same i-j. A maximum i-j (projection) is taken to find the starting indices i_start in ref__1 and j_start in ref__2. Each time indices along the main diagonal 502 analyzed and the time indices with no match are store for the respective instance in time. For example, a disruption 504 represents a region of discrepancy or a discriminative region, which indicates dissimilarity with respect to time at time indicia i and j.

Figure 6:
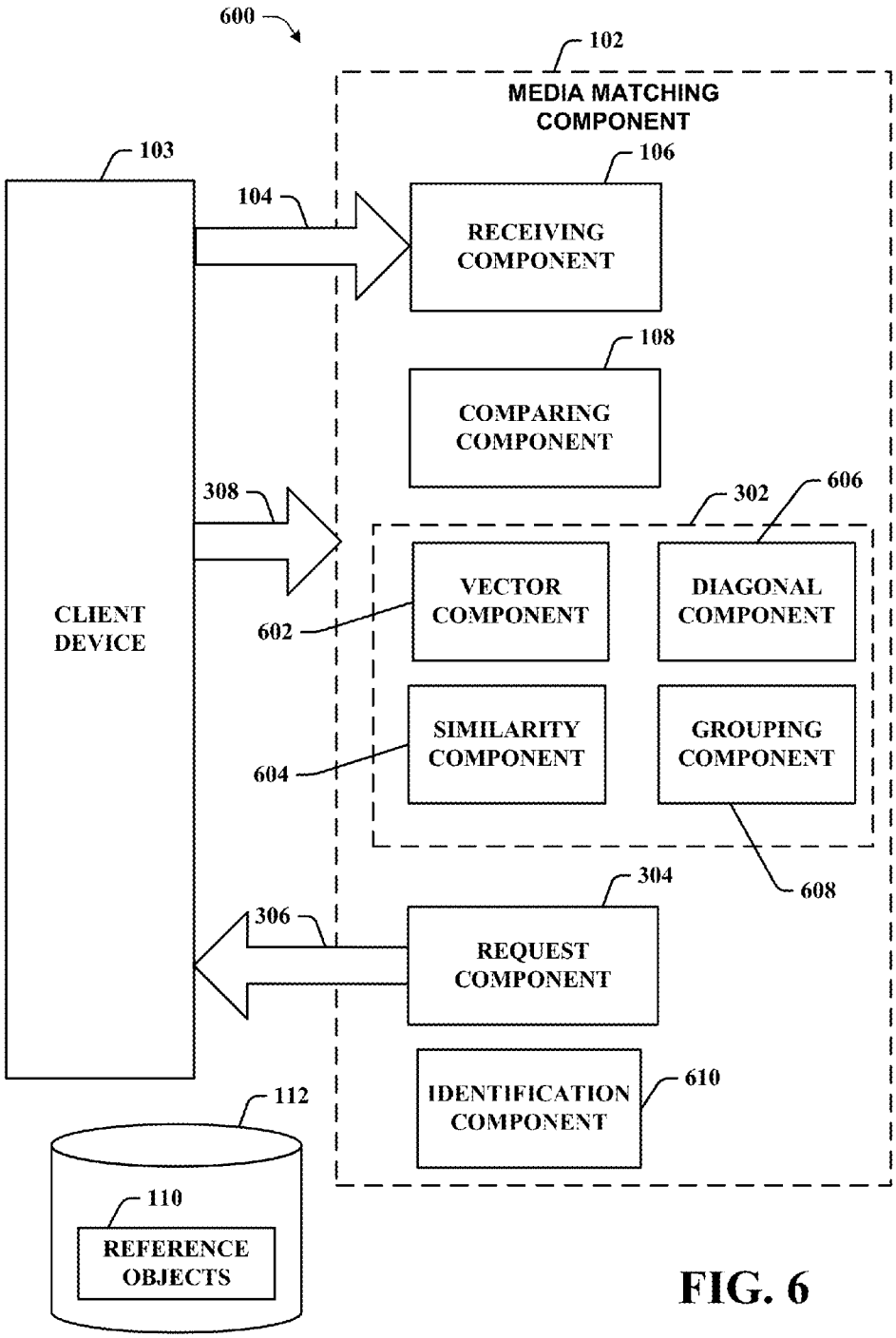
FIG. 6 is a block diagram illustrating another example, non-limiting embodiment of an identification system with a matching media component in accordance with various aspects and implementations described herein.

Referring now to FIG. 6, illustrated is a system 600 that identifies matches among near identical reference objects in accordance with various embodiments disclosed. The system 600 is a matching system with similar components as described above. The system 600 further comprises a vector component 602, a similarity component 604, a diagonal component 606, a grouping component 608, and an identification component 610.

The vector component 602 is configured to compute a set of feature vectors using feature values (e.g., auditory or audio feature values) that are included in the probe media file (e.g., the comparison object 104, or object 110 of FIG. 2). The vector component 602 determines, generates, or otherwise computes a set of vectors of auditory feature values in an audio file, for example, at a set of predetermined times and/or predetermined time intervals in order to determine matches among reference object that have nearly identical, but which can comprise one or more variance or discrepancies as discussed above. The vector component 602 can operate to compute overlapping spectrogram frames and measure a distance between frames, such as an L2 distance or a hamming distance, for example, using a more detailed fingerprint of the matching references, which can be received in response to the request 306.

The similarity component 604 generates a similarity matrix by comparing pairs of time indices between at least two reference media files having the matching reference fingerprints identified. The similarity component 604 further accumulates similarities for each of the time indices. Similarities can be calculated using a hamming distance if features vectors are in hashes according to a hash index, for example. Alternatively another similarity computation can be implemented based on the encoding of the feature vectors.

The diagonal analysis component 606 that identifies starting indices for analysis by taking a maximum of a pairwise indices projection and identifies non-matching time indices ranges along a diagonal path of the similarity matrix. The grouping component 608 operates to group the non-matching time ranges and calculates a union of the time ranges from all pairwise comparisons of the reference media files identified as matching results. This formulates a complete set of the discriminative regions across the matching reference results.

As state above, the request component 304 communicates the complete set of discriminative regions covering all matching reference results to the client device 103 for further computation of those regions identified. In response to receiving the data from the client in response to the request communicate for additional features data or data pertaining to the feature within the discrepancy regions, the identification component 610 compares the data received from client device 103, such as a fingerprint, a portion of the fingerprint, a re-computed digest, an additional spectrogram window or a portion of the probe sample having data focused with greater precision on the discriminative regions for the media content against a set of fingerprints (or identifiers) for references. The identification component 610 then operate to determine the single matching reference having the strongest matching identification based at least in part on a set of similarity criteria. The similarity criteria can include but are not limited to satisfying a predetermined similarity threshold. For example, by having additional feature data with greater detail, a single identical match from among nearly identical matches first determined by the system before sending the request (e.g., request 306) can be ascertained, and ascertained with certainty.

As an additional or alternative example, the identification component 610 can employ the portion of data, which is received from the client device 103 in response to the request and with greater discrepancies (detailed identifying features among a discrepancy region) than the probe sample first sent by the client device, to lookup or further identify reference files that are similar to the media content received. In one example, the portion of data received from the client device 103 in response to the request can be a fingerprint, for example, that can include a set of hash values. The identification component 610 can employ the set of hash values to lookup a fingerprint in the set of fingerprints for the matching reference file, for example, using a hash table. The comparing component 108, described above, is also similarly operable for determining a set of matching reference samples. Alternatively, the receiving portion of data with discriminative region data requested and received from the client device 103 can be in the form of a compact digest in which compact fingerprints of the matching references are then compared to for determining the single strongest match, such as by a comparison within the discrepancy regions with more detailed region specific data. As such, the type of data communicated by the client device is not limited herein, and can include the discriminative regions of the probe sample requested by the matching server or by the media matching component 102.

Figure 7:
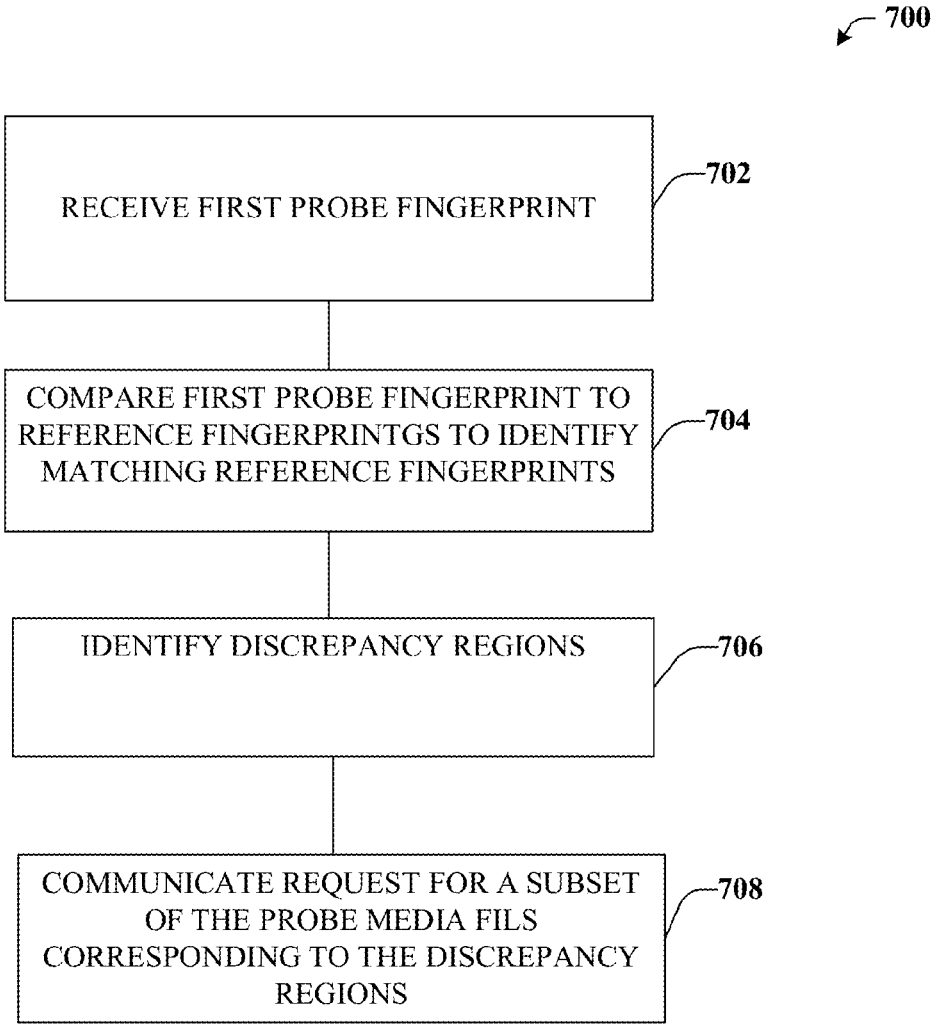
FIG. 7 illustrates a flow diagram of an example, non-limiting embodiment for identifying near identical matches in accordance with various aspects and implementations described herein.
Figure 8:
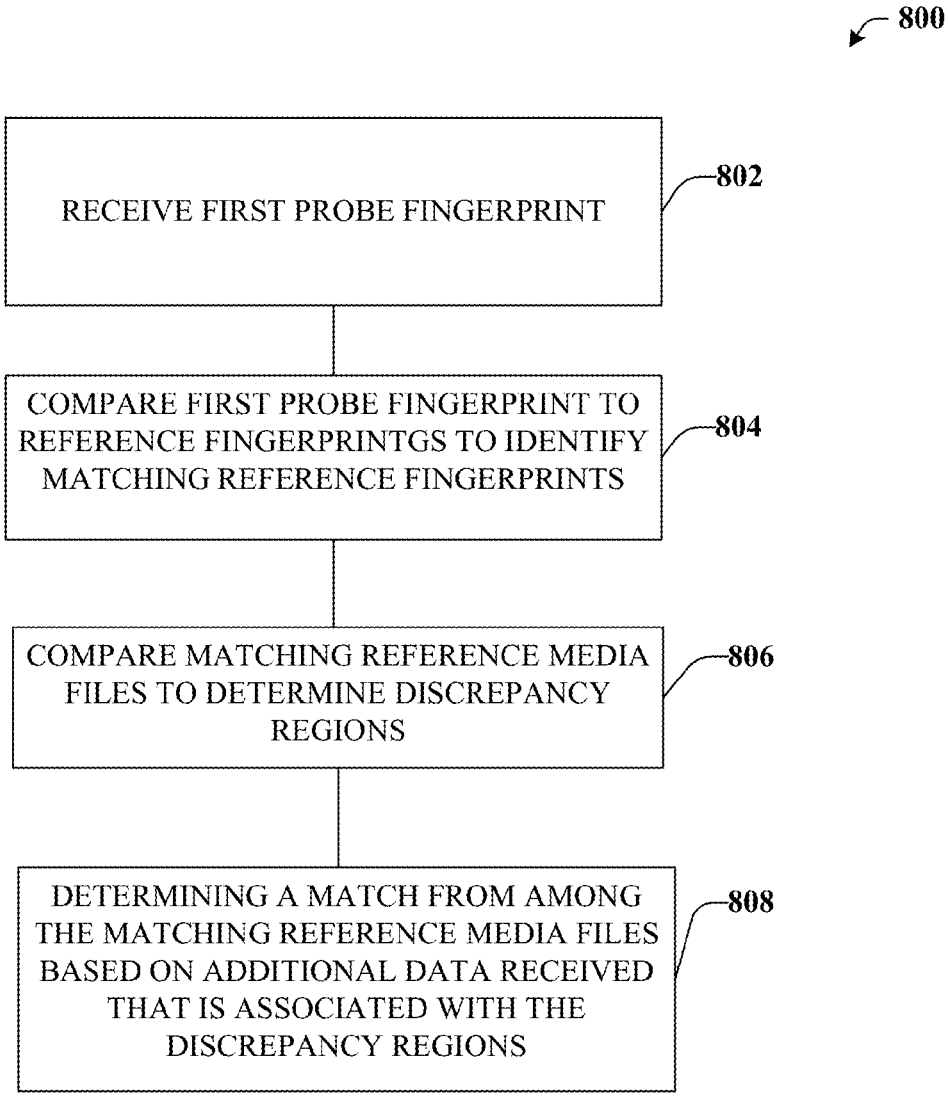
FIG. 8 illustrates a flow diagram of an example, non-limiting embodiment for identifying near identical matches in accordance with various aspects and implementations described herein.

Non-Limiting Examples of Methods for Differentiating Between Near Identical Versions of a Song FIGS. 7-8 illustrate various methodologies in accordance with the disclosed subject matter. While, for purposes of simplicity of explanation, the methodologies are shown and described as a series of acts, the disclosed subject matter is not limited by the order of acts, as some acts may occur in different orders and/or concurrently with other acts from that shown and described herein. For example, those skilled in the art will understand and appreciate that a methodology can alternatively be represented as a series of interrelated states or events, such as in a state diagram. Moreover, not all illustrated acts may be required to implement a methodology in accordance with the disclosed subject matter. Additionally, it is to be appreciated that the methodologies disclosed in this disclosure are capable of being stored on an article of manufacture to facilitate transporting and transferring such methodologies to computers or other computing devices.

Referring now to FIG. 7, illustrated is an example methodology 700 for a matching system using an analysis of discriminative regions in accordance with various aspects described in this disclosure. At reference numeral 702, the method initiates with receiving a first probe fingerprint (e.g., the comparison object 104) associated with a probe media file from a client device, such as from the client device 103, in which the client device can be a personal device having a processor and/or a storage component (e.g., a mobile device or the like). At 704, the first probe fingerprint is compared to reference fingerprints (e.g., reference object 110) associated with reference media files to identify matching reference fingerprints.

At 706, in response to identifying the matching reference fingerprints, a set of discrepancy regions are identified of the first probe fingerprint and of the matching reference fingerprints. The set of discrepancy regions, for example, can include areas of non-matching features, such as feature vectors, spectrograms, portions of spectrograms, distance measures and the like that are among the probe sample (e.g., the comparison object 104) and the matches (e.g., reference objects 110). At 708, a request is then communicated to the client device that requests a subset of the probe media file with the set of discrepancy regions identified, which comprises further details of the probe within the identified discrepancy regions for further identification of a single identical match from among the initial matching references, for example.

The method 700, therefore, can further comprise receiving the subset of the probe media file in response to communicating the request, in which the subset of the probe media file received includes a greater number of discrepancy regions than the first probe fingerprint. The subset of probe media file received from the client, for example, can include a second probe fingerprint that comprises a portion of the first probe fingerprint associated with the discrepancy regions identified and that is in greater detail for further determining an identical or exact match from among a plurality of matches identified. Comparing the subset of the probe media file to the matching reference fingerprints by using the subset of the probe media file thus further identifies a single matching second reference fingerprint, or finer detailed portion of the references, such as additional feature vectors identified as matching within a discrepancy region, additional spectrograms, additional distance measures, further portions of spectrograms and the like data as additional fingerprint information in a further comparison.

In another embodiment, the method includes comparing respective pairs of reference media files associated with the matching reference fingerprints that comprises comparing respective sequences of feature vectors using a distance measure. The comparing respective sequences of feature vectors can comprise generating the respective sequences of feature vectors using respective spectrogram frames. Alternatively or additionally, the comparing respective sequences of feature vectors can comprise generating the respective sequences of feature vectors using respective second reference fingerprints of the respective pairs of reference media files associated with the matching reference fingerprints.

The method 700 can also include generating a similarity matrix by identifying an alignment between at least two reference media files of the pairs of reference media files. Time ranges can be identified at indices that do not match along a diagonal of the similarity matrix, and thus, identified as discrepancy regions and communicated to the client device (e.g., the client 103), as detailed above. The time indices can be grouped into a set of time ranges and a union of the time ranges is calculated from each of the pairwise comparisons to generate the set of discrepancy regions.

In one embodiment, the comparisons (the first comparison of determining the matches initially from the receive probe, the second comparison in determining the exact match from among the initial matches, and/or both comparisons) are generated from among matching references, which can be identified based on overlapping spectrogram frames and measuring of a distance between normalized frames as the comparison performed. For example, the distance can relate to a standard distance metric, L1, L2, a Jaccard distance metric and/or other distance measure between feature vectors of the pairwise comparison. In addition or alternatively, more detailed fingerprint comparisons can be generated among the matching reference samples by utilizing a Hamming distance, and then compared again in response to receive the requested additional data from among the discrepancy regions from the client device. Accordingly, a comparison of more detailed features within a subset of indices ranges can be performed for determining the exact identical match from among the initial plurality of matches.

Referring now to FIG. 8, illustrated is an example methodology 800 for a matching system using an analysis of discriminative regions in accordance with various aspects described in this disclosure. At reference numeral 802, the method includes receiving a first probe fingerprint associated with a probe media file from a client device. The probe fingerprint can comprise a compact digest of a full length song, or a portion of data corresponding to an audio file. At 804, the first probe fingerprint is compared to reference fingerprints associated with reference media files to identify a set of matching reference media files having matching reference fingerprints.

At 806, the set of matching reference media files are compared to one another (e.g., in pairwise comparisons) to determine a set of discrepancy regions (detail features from among an indicia range, such as an origin 0,0 to i,j of a matrix diagonal). The method at 806 can further include communicating the set of discrepancy regions to the client device. In response to the communication, additional data can be received that is associated with the discrepancy regions to further compare the additional data with the set of matching reference media files and identify the match. In another embodiment, generating discriminative or discrepancy regions can include generating a similarity matrix by identifying an alignment between the set of matching reference media files. Time ranges are identified at non-matching areas along a diagonal path of the similarity matrix. The time indices can then be grouped into a set of time ranges and a union calculated across the time ranges from each of the pairwise comparisons to generate the set of discrepancy regions.

At 808, a single match is determined from among the set of matching reference media files based on additional data of the probe media file associated with the discrepancy regions. The additional data can be from the client device(s) that communicated the first probe fingerprint.

In one embodiment, sequences of feature vectors from among the matching references files can be compared using a hamming distance measure, and/or by computing overlapping spectrogram frames and using a distance measure, which can be performed in an initial comparison for matching references and/or in greater detail in response to receive the data from the client device (e.g., client device 103) for determining the exact match from among the matching references.

Exemplary Networked and Distributed Environments

One of ordinary skill in the art can appreciate that the various embodiments described herein can be implemented in connection with any computer or other client or server device, which can be deployed as part of a computer network or in a distributed computing environment, and can be connected to any kind of data store where media may be found. In this regard, the various embodiments described herein can be implemented in any computer system or environment having any number of memory or storage units, and any number of applications and processes occurring across any number of storage units. This includes, but is not limited to, an environment with server computers and client computers deployed in a network environment or a distributed computing environment, having remote or local storage.

Distributed computing provides sharing of computer resources and services by communicative exchange among computing devices and systems. These resources and services include the exchange of information, cache storage and disk storage for objects, such as files. These resources and services also include the sharing of processing power across multiple processing units for load balancing, expansion of resources, specialization of processing, and the like. Distributed computing takes advantage of network connectivity, allowing clients to leverage their collective power to benefit the entire enterprise. In this regard, a variety of devices may have applications, objects or resources that may participate in mechanisms as described for various embodiments of this disclosure.

Figure 9:
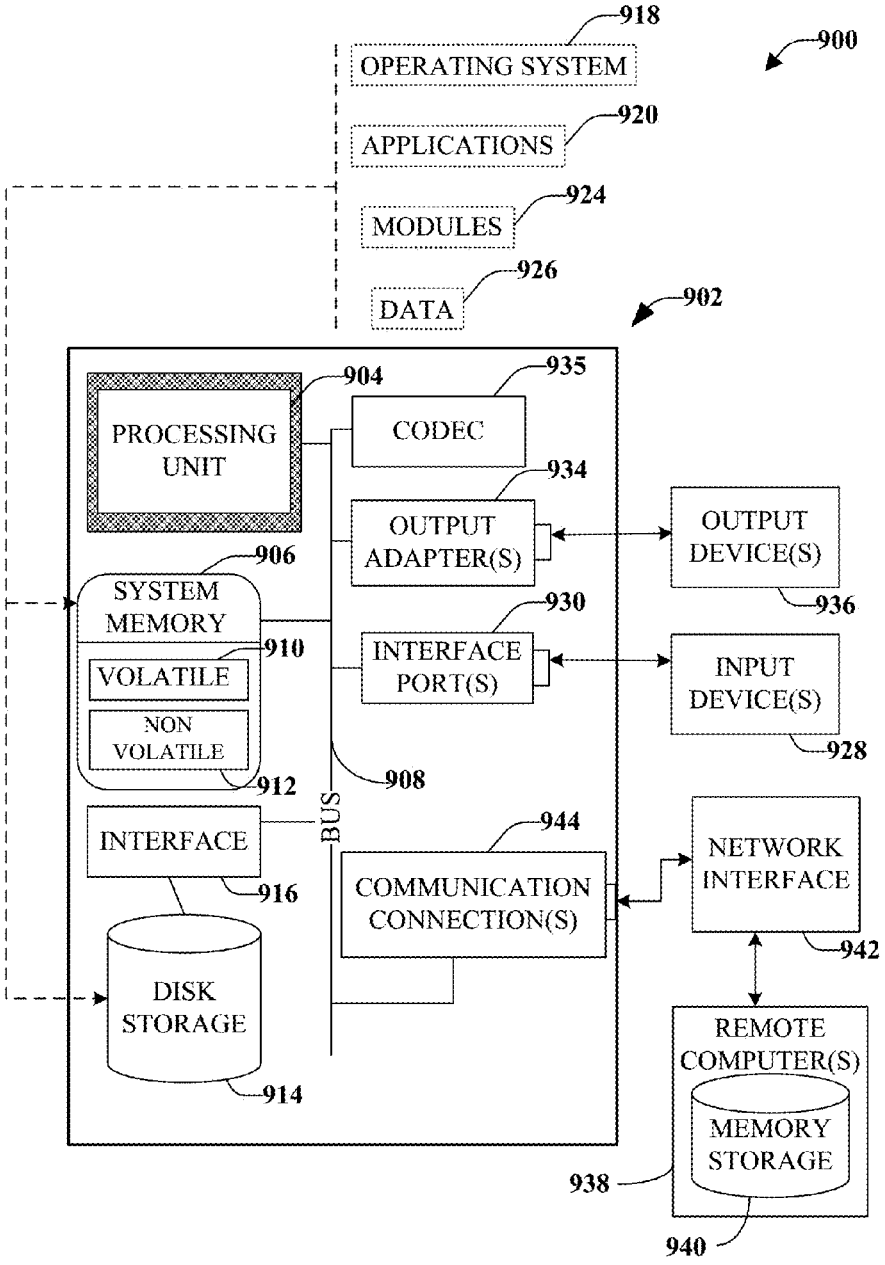
FIG. 9 is a block diagram illustrating an example computing device that is arranged in accordance with various aspects and implementations described herein.

FIG. 9 provides a schematic diagram of an exemplary networked or distributed computing environment. The distributed computing environment comprises computing objects 910, 912, etc. and computing objects or devices 920, 922, 924, 926, 928, etc., which may include programs, methods, data stores, programmable logic, etc., as represented by applications 930, 932, 934, 936, 938. It can be appreciated that computing objects 99, 912, etc. and computing objects or devices 920, 922, 924, 926, 928, etc. may comprise different devices, such as personal data assistants (PDAs), audio/video devices, mobile phones, MP3 players, personal computers, tablets, laptops, etc.

Each computing object 910, 912, etc. and computing objects or devices 920, 922, 924, 926, 928, etc. can communicate with one or more other computing objects 910, 912, etc. and computing objects or devices 920, 922, 924, 926, 928, etc. by way of the communications network 940, either directly or indirectly. Even though illustrated as a single element in FIG. 9, network 940 may comprise other computing objects and computing devices that provide services to the system of FIG. 9, and/or may represent multiple interconnected networks, which are not shown. Each computing object 910, 912, etc. or computing objects or devices 920, 922, 924, 926, 928, etc. can also contain an application, such as applications 930, 932, 934, 936, 938, that might make use of an API, or other object, software, firmware and/or hardware, suitable for communication with or implementation various embodiments of this disclosure.

There are a variety of systems, components, and network configurations that support distributed computing environments. For example, computing systems can be connected together by wired or wireless systems, by local networks or widely distributed networks. Currently, many networks are coupled to the Internet, which provides an infrastructure for widely distributed computing and encompasses many different networks, though any network infrastructure can be used for exemplary communications made incident to the systems as described in various embodiments.

Thus, a host of network topologies and network infrastructures, such as client/server, peer-to-peer, or hybrid architectures, can be employed. The "client" is a member of a class or group that uses the services of another class or group to which it is not related. A client can be a process, e.g., roughly a set of instructions or tasks, that requests a service provided by another program or process. The client may be or use a process that utilizes the requested service without having to "know" any working details about the other program or the service itself.

In a client/server architecture, particularly a networked system, a client is usually a computer that accesses shared network resources provided by another computer, e.g., a server. In the illustration of FIG. 9, as a non-limiting example, computing objects or devices 920, 922, 924, 926, 928, etc. can be thought of as clients and computing objects 99, 912, etc. can be thought of as servers where computing objects 910, 912, etc. provide data services, such as receiving data from client computing objects or devices 920, 922, 924, 926, 928, etc., storing of data, processing of data, transmitting data to client computing objects or devices 920, 922, 924, 926, 928, etc., although any computer can be considered a client, a server, or both, depending on the circumstances.

A server is typically a remote computer system accessible over a remote or local network, such as the Internet or wireless network infrastructures. The client process may be active in a first computer system, and the server process may be active in a second computer system, communicating with one another over a communications medium, thus providing distributed functionality and allowing multiple clients to take advantage of the information-gathering capabilities of the server.

In a network environment in which the communications network/bus 940 is the Internet, for example, the computing objects 910, 912, etc. can be Web servers with which the client computing objects or devices 920, 922, 924, 926, 928, etc. communicate via any of a number of known protocols, such as the hypertext transfer protocol (HTTP). Objects 910, 912, etc. may also serve as client computing objects or devices 920, 922, 924, 926, 928, etc., as may be characteristic of a distributed computing environment.

Exemplary Computing Device

As mentioned, advantageously, the techniques described herein can be applied to any device suitable for implementing various embodiments described herein. Handheld, portable and other computing devices and computing objects of all kinds are contemplated for use in connection with the various embodiments, e.g., anywhere that a device may wish to read or write transactions from or to a data store. Accordingly, the below general purpose remote computer described below in FIG. 10 is but one example of a computing device.

Although not required, embodiments can partly be implemented via an operating system, for use by a developer of services for a device or object, and/or included within application software that operates to perform one or more functional aspects of the various embodiments described herein. Software may be described in the general context of computer executable instructions, such as program modules, being executed by one or more computers, such as client workstations, servers or other devices. Those skilled in the art will appreciate that computer systems have a variety of configurations and protocols that can be used to communicate data, and thus, no particular configuration or protocol is to be considered limiting.

Figure 10:
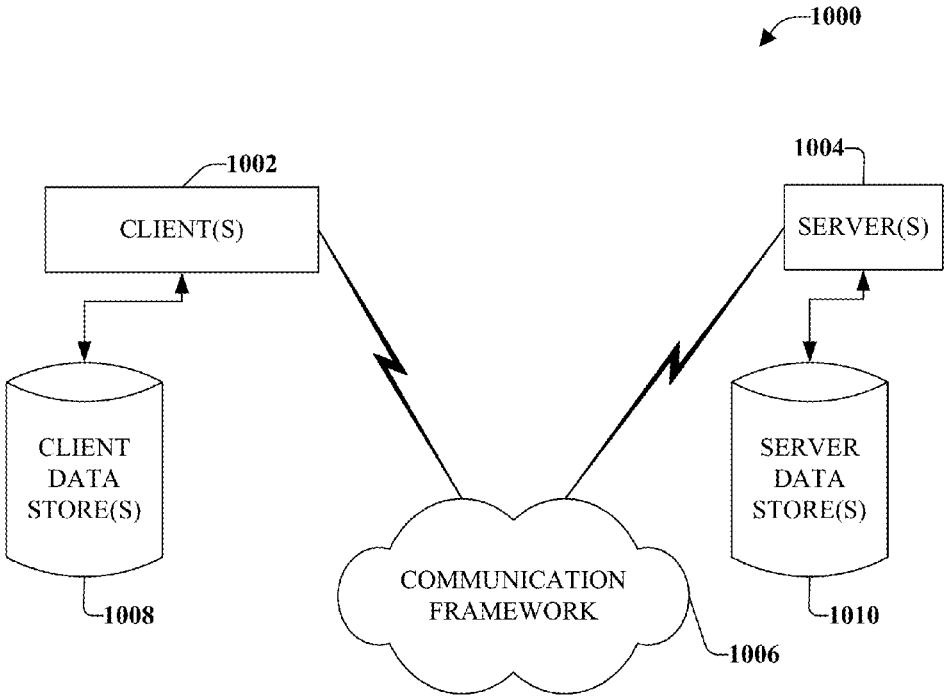
FIG. 10 is a block diagram illustrating an example networking environment in accordance with various aspects and implementations of this disclosure.

FIG. 10 thus illustrates an example of a suitable computing system environment 1000 in which one or aspects of the embodiments described herein can be implemented, although as made clear above, the computing system environment 1000 is only one example of a suitable computing environment and is not intended to suggest any limitation as to scope of use or functionality. Neither is the computing environment 1000 be interpreted as having any dependency or requirement relating to any one or combination of components illustrated in the exemplary operating environment 1000.

With reference to FIG. 10, an exemplary remote device for implementing one or more embodiments includes a general purpose computing device in the form of a computer 1010. Components of computer 1010 may include, but are not limited to, a processing unit 1020, a system memory 1030, and a system bus 1022 that couples various system components including the system memory to the processing unit 1020.

Computer 1010 includes a variety of computer readable media and can be any available media that can be accessed by computer 1010. The system memory 1030 may include computer storage media in the form of volatile and/or nonvolatile memory such as read only memory (ROM) and/or random access memory (RAM). By way of example, and not limitation, memory 1030 may also include an operating system, application programs, other program modules, and program data.

A user can enter commands and information into the computer 1010 through input devices 1040. A monitor or other type of display device is also connected to the system bus 1022 via an interface, such as output interface 1050. In addition to a monitor, computers can also include other peripheral output devices such as speakers and a printer, which may be connected through output interface 1050.

The computer 1010 may operate in a networked or distributed environment using logical connections to one or more other remote computers, such as remote computer 1070. The remote computer 1070 may be a personal computer, a server, a router, a network PC, a peer device or other common network node, or any other remote media consumption or transmission device, and may include any or all of the elements described above relative to the computer 1010. The logical connections depicted in FIG. 10 include a network 1072, such local area network (LAN) or a wide area network (WAN), but may also include other networks/buses. Such networking environments are commonplace in homes, offices, enterprise-wide computer networks, intranets and the Internet.

As mentioned above, while exemplary embodiments have been described in connection with various computing devices and network architectures, the underlying concepts may be applied to any network system and any computing device or system in which it is desirable to publish or consume media in a flexible way.

The word "exemplary" is used herein to mean serving as an example, instance, or illustration. For the avoidance of doubt, this matter disclosed herein is not limited by such examples. In addition, any aspect or design described herein as "exemplary" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, for the avoidance of doubt, such terms are intended to be inclusive in a manner similar to the term "comprising" as an open transition word without precluding any additional or other elements.

Computing devices typically include a variety of media, which can include computer-readable storage media. Computer-readable storage media can be any available storage media that can be accessed by the computer, is typically of a non-transitory nature, and can include both volatile and non-volatile media, removable and non-removable media. By way of example, and not limitation, computer-readable storage media can be implemented in connection with any method or technology for storage of information such as computer-readable instructions, program modules, structured data, or unstructured data. Computer-readable storage media can include, but are not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

As mentioned, the various techniques described herein may be implemented in connection with hardware or software or, where appropriate, with a combination of both. As used herein, the terms "component," "system" and the like are likewise intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on computer and the computer can be a component. One or more components may reside within a process and/or thread of execution and a component may be localized on one computer and/or distributed between two or more computers. Further, a component can come in the form of specially designed hardware; generalized hardware made specialized by the execution of software thereon that enables the hardware to perform specific function (e.g., coding and/or decoding); software stored on a computer readable medium; or a combination thereof.

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it is to be noted that one or more components may be combined into a single component providing aggregate functionality or divided into several separate sub-components, and that any one or more middle layers, such as a management layer, may be provided to communicatively couple to such sub-components in order to provide integrated functionality. Any components described herein may also interact with one or more other components not specifically described herein but generally known by those of skill in the art.

In view of the exemplary systems described above, methodologies that may be implemented in accordance with the described subject matter will be better appreciated with reference to the flowcharts of the various figures. While for purposes of simplicity of explanation, the methodologies are shown and described as a series of blocks, the claimed subject matter is not limited by the order of the blocks, as some blocks may occur in different orders and/or concurrently with other blocks from what is depicted and described herein. Where non-sequential, or branched, flow is illustrated via flowchart, it can be appreciated that various other branches, flow paths, and orders of the blocks, may be implemented which achieve the same or a similar result. Moreover, not all illustrated blocks may be required to implement the methodologies described hereinafter.

In addition to the various embodiments described herein, it is to be understood that other similar embodiments can be used or modifications and additions can be made to the described embodiment(s) for performing the same or equivalent function of the corresponding embodiment(s) without deviating there from. Still further, multiple processing chips or multiple devices can share the performance of one or more functions described herein, and similarly, storage can be affected across a plurality of devices. Accordingly, the disclosure is not to be limited to any single embodiment, but rather can be construed in breadth, spirit and scope in accordance with the appended claims.

What is claimed is:

1. A method, comprising:

receiving, by a system including a processor, a first probe fingerprint associated with a probe media file from a client device;

comparing, by the system, the first probe fingerprint to reference fingerprints associated with reference media files to identify matching reference fingerprints;

in response to identifying the matching reference fingerprints, identifying, by the system, a set of discrepancy regions of the first probe fingerprint and the matching reference fingerprints comprising:

comparing respective pairs of reference media files associated with the matching reference fingerprints, comprising comparing respective sequences of feature vectors associated with the reference media files using a distance measure, generating a similarity matrix by identifying an alignment between at least two reference media files of the pairs of reference media files, identifying time ranges at indices that do not match along a diagonal of the similarity matrix, and grouping the time ranges into a set of time ranges and determining a union of the time ranges in the set of time ranges to generate the set of discrepancy regions;

communicating, by the system, to the client device a request for additional data regarding the probe media file associated with the set of discrepancy regions identified;

receiving, by the system, the additional data regarding the probe media file in response to communicating the request.

2. The method of claim 1, wherein the additional data regarding the probe media file includes a greater number of details within the identified discrepancy regions than the received first probe fingerprint for determining an exact match among the matching reference fingerprints.

3. The method of claim 2, wherein the additional data regarding the probe media file includes a second probe fingerprint associated with the discrepancy regions.

4. The method of claim 1, wherein the distance measure is a hamming distance measure.

5. The method of claim 1, wherein the comparing the respective sequences of feature vectors comprises generating the respective sequences of feature vectors using respective spectrogram frames.

6. The method of claim 1, wherein the comparing the respective sequences of feature vectors comprises generating the respective sequences of feature vectors using respective second reference fingerprints of the reference media files associated with the matching reference fingerprints.

7. The method of claim 1, wherein the distance measure is a Jaccard distance measure.

8. The method of claim 2, further comprising:

comparing, by the system, the additional data regarding the probe media file to the matching reference fingerprints to identify a single matching reference fingerprint that identifies the exact match.

9. The method of claim 8, wherein the comparing the additional data regarding the probe media file to the matching reference fingerprints comprises comparing a second probe fingerprint associated with the discrepancy regions to the matching reference fingerprints.

10. A system, comprising:

a memory storing computer executable components; and a processor configured to execute the following computer executable components stored in the memory:

a receiving component configured to receive a first probe fingerprint associated with a probe media file from a client device;

a comparing component configured to generate a comparison of the first probe fingerprint to reference fingerprints associated with reference media files to identify matching reference fingerprints;

a similarity component configured to generate a similarity matrix by comparison of pairs of time indices between at least two reference media files having the matching reference fingerprints and accumulation of similarities for each of the time indices;

a diagonal analysis component configured to, for respective pairs of time indices, identify starting indices for analysis by taking a maximum of a pairwise indices projection and identify non-matching time indices ranges along a diagonal path of the similarity matrix; and a grouping component that groups the non-matching time ranges and calculates a union of the non-matching time ranges from pairwise comparisons of the time indices of the at least two reference media files;

a discrepancy component configured to identify discrepancy regions associated with the matching reference fingerprints based on the union of the non-matching time ranges; and a request component configured to communicates a request to receive a data portion associated with the probe media file that corresponds to at least one discrepancy region of the discrepancy regions; and wherein the receiving component is further configured to receive the data portion associated with the probe media file.

11. The system of claim 10, wherein the comparing component is further configure to compare the data portion associated with the probe media file to the matching reference fingerprints and identify a single matching reference fingerprint.

12. The system of claim 10, wherein the comparing component is further configure to compare pairs of reference media files associated with the matching reference fingerprints by comparing sequences of feature vectors associated with the reference media files using a distance measure.

13. The system of claim 10, further comprising:

a vector component that computes a set of feature vectors using auditory feature values included in the probe media file.

14. The system of claim 10, wherein the data portion comprises data that is more highly discriminative with respect to the at least one discrepancy region than the first probe fingerprint.

15. The system of claim 14, wherein the data portion includes a second probe fingerprint based upon the greater detail.

16. A non-transitory computer-readable medium having instructions stored thereon that, in response to execution, cause a system including a processor to perform operations, comprising:

receiving a first probe fingerprint associated with a probe media file from a client device;

comparing the first probe fingerprint to reference fingerprints associated with reference media files to identify a set of matching reference media files having matching reference fingerprints;

comparing respective pairs of reference media files in the set of matching reference media files to determine a set of discrepancy regions comprising:

generating at least one similarity matrix by identifying an alignment between reference media files in the set of matching reference media files, identifying time ranges at non-matching areas along a diagonal path of the at least one similarity matrix, and grouping the time ranges into a set of time ranges and determining a union of the time ranges in the set of time ranges to generate the set of discrepancy regions;

communicating the set of discrepancy regions to the client device;

receiving additional data that is associated with the discrepancy regions from the client device; and determining a matching reference media file from among the set of matching reference media files based on the additional data of the probe media file associated with the discrepancy regions.

17. The non-transitory computer-readable medium of claim 16, wherein the additional data comprises more discriminative information with respect to the discrepancy regions than the first probe fingerprint.

18. The non-transitory computer-readable medium of claim 16, the operations further comprising:

comparing the additional data with the set of matching reference media files to identify the matching reference media file.

19. The non-transitory computer-readable medium of claim 18, wherein the comparing the respective pairs of reference media files comprises Ulna:

comparing sequences of feature vectors associated with the matching reference media files using a hamming distance measure.

20. The non-transitory computer-readable medium of claim 18, wherein the comparing the respective pairs of reference media files comprises:

comparing sequences of feature vectors associated with the matching reference media files by computing overlapping spectrogram frames and using a distance measure.

* * * * *